US006325138B1

(12) United States Patent
Garosshen et al.

(10) Patent No.: US 6,325,138 B1
(45) Date of Patent: Dec. 4, 2001

(54) ARTICLE EXHIBITING IMPROVED RESISTANCE TO GALVANIC CORROSION

(75) Inventors: Thomas J. Garosshen, Glastonbury, CT (US); Sandra J. Downey, Cazenovia; Daniel P. Gaffaney, Chittenango, both of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/258,668

(22) Filed: Feb. 26, 1999

Related U.S. Application Data

(63) Continuation-in-part of application No. 08/734,146, filed on Oct. 21, 1996.

(51) Int. Cl.[7] ..... F28F 19/02

(52) U.S. Cl. ..... 165/133; 165/134.1; 228/183

(58) Field of Search ..... 165/133, 134.1; 228/183

(56) References Cited

U.S. PATENT DOCUMENTS 2,159,510 * 5/1939 Pavlish et al. ..... 204/37 T
3,855,679 * 12/1974 Schmatz ..... 29/197
4,032,059 * 6/1977 Plegat ..... 228/183
4,817,857 * 4/1989 Hargrove et al. ..... 228/183
4,826,895 * 5/1989 Kanai et al. ..... 523/443
5,042,574 * 8/1991 Cottone et al. ..... 165/133
5,435,968 * 7/1995 Panthofer ..... 420/561
5,554,234 * 9/1996 Takeuchi et al. ..... 148/551
5,555,931 * 9/1996 Lee et al. ..... 165/122

* cited by examiner

*Primary Examiner*—Allen Flanigan

(57) ABSTRACT

An article having a first member formed from a first metal and a second member connected with the first member at a contact area. The second member is formed from a second metal having high reduction reaction kinetics and galvanic corrosion driving force relative the first member, wherein the second metal is more noble than the first metal. A material for substantially eliminating the galvanic corrosion problem by reducing the reduction reaction kinetics of the second metal in the presence of an electrolyte is provided between the first and second metals. In a preferred embodiment, the article is a heat exchanger wherein the first member is a fin collar and the second member a tube and the material for reducing is a coating on the tube has low reduction reaction kinetics relative to copper for reducing corrosion activities between the tube and fin collar.

5 Claims, 3 Drawing Sheets

Galvanic Series of Some
Commercial Metals and Alloys in Seawater

| | |
|---|---|
| | Platinum |
| | Gold |
| Noble or | Graphite |
| cathodic | Titanium |
| | Silver |
| | Chlorimet 3 (62 Ni, 18 Cr, 18 Mo) |
| | Hastelloy C (62 Ni, 17 Cr, 15 Mo) |
| | 18.8 Mo stainless steel (passive) |
| | 18.8 stainless steel (passive) |
| | Chromium stainless 11-30% Cr (passive) |
| | Inconel (passive) (80 Ni, 13 Cr, 7 Fe) |
| | Nickel (passive) |
| | Silver solder |
| | Monel (70 Ni, 30 Cu) |
| | Cupronickels (60-90 Cu, 40-10 Ni) |
| | Bronzes (Cu-Sn) |
| | Copper |
| | Brasses (Cu-Zn) |
| | Chlorimet 2 (66 Ni, 32 Mo, 1 Fe) |
| | Hastelloy B (60 Ni, 30 Mo, 6 Fe, 1 Mn) |
| | Inconel (active) |
| | Nickel (active) |
| | Tin |
| | Lead |
| | Lead-tin solders |
| | 18.8 Mo stainless steel (active) |
| | 18.8 stainless steel (active) |
| | Ni-Resist (high Ni cast iron) |
| | Chromium stainless steel, 13% Cr (active) |
| | Cast iron |
| | Steel or iron |
| | 2024 aluminum (4.5 Cu, 1.5 Mg, 0.6 Mo) |
| Active or | Cadium |
| anodic | Commercially pure aluminum (1100) |
| | Zinc |
| | Magnesium and magnesium alloys |

FIG. 3

ARTICLE EXHIBITING IMPROVED RESISTANCE TO GALVANIC CORROSION

This application is a continuation-in-part of pending application Ser. No. 08/734,146, having a filing date of Oct. 21, 1996.

TECHNICAL FIELD

This invention relates generally to protecting metals from a corrosive environment, and more specifically to protecting copper-aluminum heat exchangers from corrosion when used in air conditioners.

BACKGROUND ART

Corrosion is a process that involves two simultaneous reactions which are called half-cells. One half-cell reaction is the oxidation or corrosion of the metal. This process involves the loss of electrons, e.g., $$2M \rightarrow 2M^{+} + 2e^{-}$$

Electrons from the oxidation process are in turn used by an associated reduction half-cell reaction, which is often the reduction of oxygen or hydrogen, e.g., $$O_2 + 4H^{+} + 4e^{-} \rightarrow 2H_2O$$

$$2H^{+} + 2e^{-} \rightarrow H_2$$

The oxidation reaction (corrosion process) can only proceed at a rate governed by the reduction reaction that uses the electrons from the oxidation process. This is because charge neutrality must be maintained.

Galvanic corrosion occurs when two dissimilar metals make contact with one another in the presence of an electrolyte thereby forming a galvanic couple. The more noble metal (more cathodic on the galvanic series) provides additional surface area for the reduction reaction to occur on. This accelerates the oxidation/corrosion of the less noble metal (more anodic on the galvanic series). The extent of corrosion is greatest at the interface of the two metals, but may also occur at some distance away from the actual interface.

Heat exchangers made of copper tubes and aluminum fins have about ten times lower corrosion durability as compared to those made with aluminum fins and aluminum tubes. This, as discussed above, is because when two dissimilar metals (like copper and aluminum) are in contact with each other in a corrosive environment, a galvanic couple forms and the more noble metal promotes the corrosion of the more active metal. The adverse role of the more noble metal, copper in this application, is that: (1) it provides additional surface area for the reduction reaction of the corrosion process to occur on, and (2) corrosion reduction reaction rates are very high on copper. Both of these factors accelerate the corrosion process and result in a ten-fold increase in corrosion rate of the aluminum fins.

In coastal regions, the most common electrolyte is salt water. A fine salt water mist may be blown inland for up to fifty miles from the coast. Sulfur dioxide and other industrial pollutants also creates an electrolyte when combined with moisture.

A common method of preventing galvanic corrosion has been to coat the exposed surfaces of the corroding metal with various types of paint. These protective coatings have met with only limited success for a number of reasons. The main problem with these types of coatings is that their effectiveness at preventing corrosion is degraded by exposure to the environmental elements such as ultraviolet light and acid rain. Another common problem is that the coating materials often do not adhere well to the metal substrates and eventually flake off or erode away exposing the metal substrates. Moreover, such protective coatings are somewhat porous and allow the electrolyte to penetrate the surface of the substrates and connect the galvanic couple. Such coatings can also be relatively expensive.

When using aluminum fins and copper tubes, coating the aluminum fin stock is a current prevalent option. However, this approach decreases the thermal efficiency of a heat exchanger because it inserts a thermal conduction barrier between the fin and the tube. It also has the potential problems of: (1) rapid corrosive attack at the bare aluminum sheared edges near the fin collar due to the large increase in the ratio between the copper and aluminum surfaces, (2) increased tool wear and fouling during the fin stamping process, and (3) added costs.

The current art of protective coatings is to protect a metal that corrodes by covering it with a coating or paint that shields it from the aggressive environment. This concept is well known and involves coatings such as paints or metallic coatings that protect the substrate such as galvanized steel. In the case of galvanized steel the zinc coating is also sacrificial to the steel substrate. For galvanic couples, the two metal combinations can be made more compatible by selecting metals near or similar to each other on the galvanic series, which effectively reduces the driving force for galvanic corrosion.

DISCLOSURE OF INVENTION

The primary object of this invention is to provide an article, preferably a heat exchanger, having improved corrosion resistant properties when used in a corrosive environment.

Another object of this invention is to provide a plate-fin heat exchanger formed from the preferred materials of copper and aluminum, for the tube and fins, respectively, having reduced reduction reaction kinetics for inhibiting corrosive activities between these materials.

Yet another object of this invention is to provide a plate-fin heat exchanger formed from the preferred materials of copper and aluminum, for the tube and fins, respectively, having a reduction reaction kinetics reducing surface treatment on the non-corroding copper tube for inhibiting galvanic corrosion of the less noble aluminum fin collars relative the more noble copper tube.

Still another object of this invention is to provide a plate-fin heat exchanger formed from the preferred materials of copper and aluminum, for the tube and fins, respectively, having a surface treatment of tin on the non-galvanically corroding copper tube, for substantially reducing the reduction reaction kinetics otherwise a property of the copper, for inhibiting galvanic corrosion of the less noble aluminum fin collars relative to the more noble copper tube.

The foregoing objects and following advantages are achieved by the article of the present invention including a first member formed from a first metal and a second member connected with the first member at a contact area. The second member is formed from a second metal having high reduction reaction kinetics relative the first member, wherein the second metal is more noble than the first metal. A material or substance for reducing the reduction reaction kinetics of the second metal for reducing galvanic corrosion of the first metal in the presence of an electrolyte is provided between the first and second metals. In a preferred embodiment, the article is a heat exchanger wherein the first member is a fin collar and the second member is a tube, and the material for reducing is a coating on the tube which has low reduction reaction kinetics relative the copper for reducing corrosion activities between the tube and fin collar.

BRIEF DESCRIPTION OF DRAWINGS

FIG. 3 is a table illustrating the Galvanic Series.

BEST MODE FOR CARRYING OUT THE INVENTION

Figure 1:
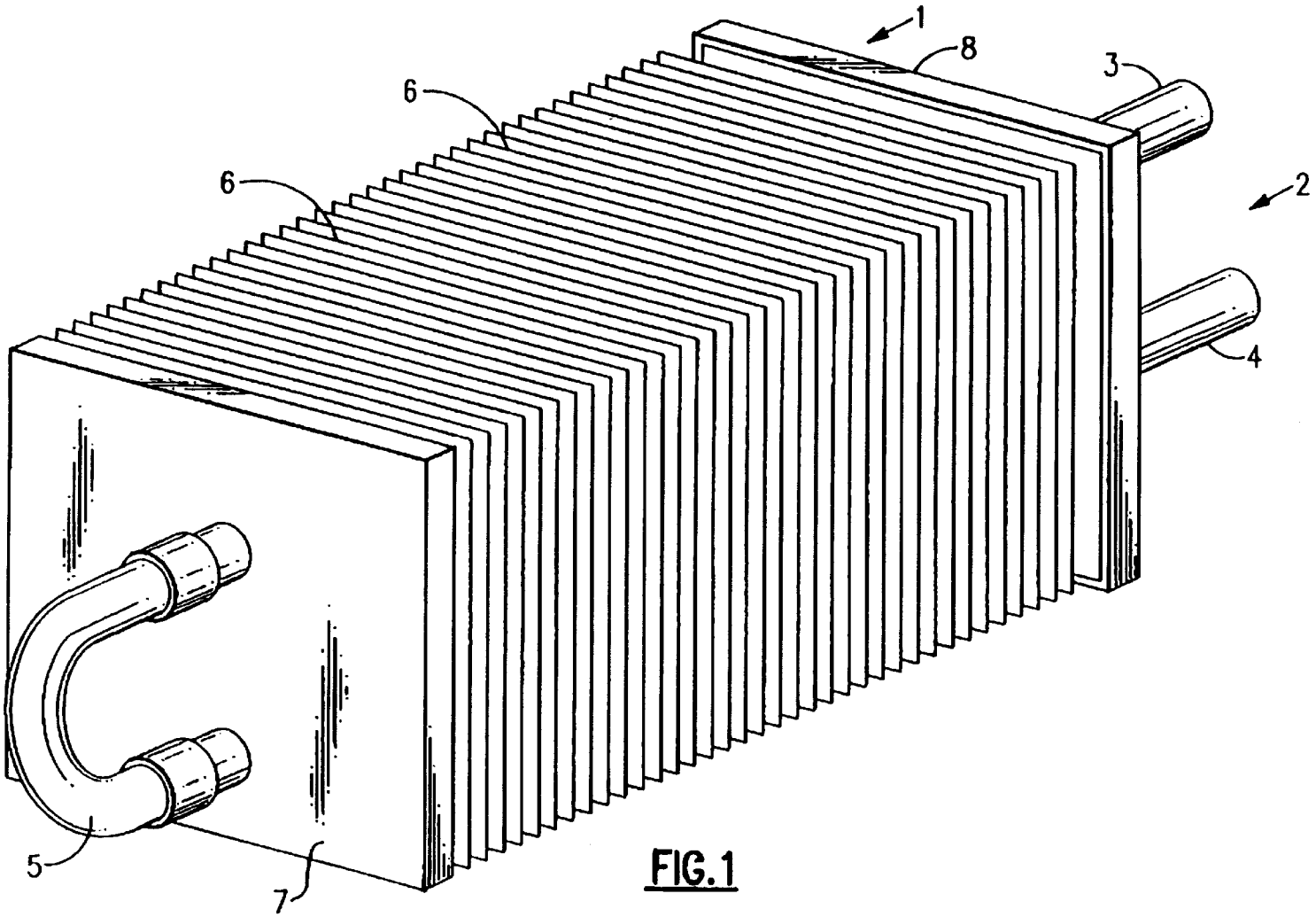
FIG. 1 is a perspective view of a heat exchanger incorporating heat exchanger tubes treated in accordance with the present invention.

As will be described in detail below, the present invention provides for corrosion protection of a copper-aluminum heat exchanger. However, it should be evident to one skilled in the art that the present invention is not limited to this specific example and could be used in connection with a number of arrangements where dissimilar metals are in contact with one another in the presence of an electrolyte. FIG. 1 illustrates a plate-fin heat exchanger 1 of the type typically used in air conditioning units. The heat exchanger includes one or more flow circuits for carrying refrigerant through the heat exchanger unit. For the purposes of explanation, the heat exchanger 1 contains a single flow circuit tube 2 consisting of an inlet line 3 and an outlet line 4 which are connected at one end of the heat exchanger 1 by means of a 90° tube bend 5. It should be evident, however, that more circuits may be added to the unit depending upon the demands of the system. The unit further includes a series of fins 6 comprising radial disposed plate like elements spaced along the length of the flow circuit. The fins 6 are supported in the assembly between a pair of end plates 7 and 8 to define a gas flow passage through which a gas passes over the extension of the tube 2 and between the spaced fins 6.

As noted above, heat exchangers of this type are commonly used in corrosive environments. In a typical arrangement, heat exchangers of this type are fabricated utilizing copper for the circuit flow tubes and aluminum for the fins. The fins are disposed in contact with the tubes and draw heat away through conductive heat transfer and then dissipate the heat through convective heat transfer to the gas (commonly air) flowing over the tubes. Copper is utilized in tube construction because of its good heat transfer properties, general resistance to corrosion, and ease of fabrication and repair. The fins are fabricated from aluminum because of its good heat transfer properties, ease of fabrication, and low cost. Heat exchangers fabricated entirely from copper, as well as entirely from aluminum, are utilized in certain applications to avoid the problems of galvanic corrosion. However, these heat exchangers have disadvantages of higher cost and difficult fabrication and repair. Aluminum is significantly more anodic on the galvanic series, i.e. less noble, than copper. It is for this reason that the aluminum oxidizes or corrodes when it is in contact with copper in the presence of an electrolyte. In the arrangement shown in FIG. 1, the interface of the tube and fin is where the galvanic couple would be made and where the corrosion of the aluminum fins would most likely occur without some form of prevention. Once the fin corrodes at the intersection, the fin no longer contacts the tube and thus the heat exchanger efficiency is greatly reduced because the fin loses its ability to conduct heat away from the tube.

In accordance with the present invention the exposed surfaces of the copper tubes 2 are coated or enriched with a material for reducing the reduction reaction rate which drives the galvanic couple between the copper and aluminum, as opposed to coating the element targeted for corrosion, i.e. the fins. Tin alloys are the best candidates for this material since they offer very low reduction reaction kinetics. Thus, this lowering of reduction reaction kinetics can be accomplished by coating or impregnating the copper tubing's surface with a layer which has such lower reduction reaction kinetics as compared to copper. As indicated in the background section, galvanic corrosion problems are traditionally prevented by coating the corroding material with a metal galvanically compatible with the more noble element, or, by switching to compatible metals that are close together on the galvanic series. If the two metals are close together on the galvanic series there is little driving force for the galvanic corrosion process. In contrast, a new approach is invented herein. Instead of coating the corroding metal or selecting metals close together on the galvanic series, a metallic coating that has low reduction reaction kinetics is used even if the galvanic series indicates there is a high driving force between the metal coating and the non-coated element, due to their spacing on the galvanic series. This approach is novel in that: (1) it is not based on the most typical protection method, barrier coatings (paints) that shield the corrosion prone aluminum fins from the environment and (2) nor is it based upon selecting galvanically compatible metals that do not form a galvanic couple.

Figure 2:
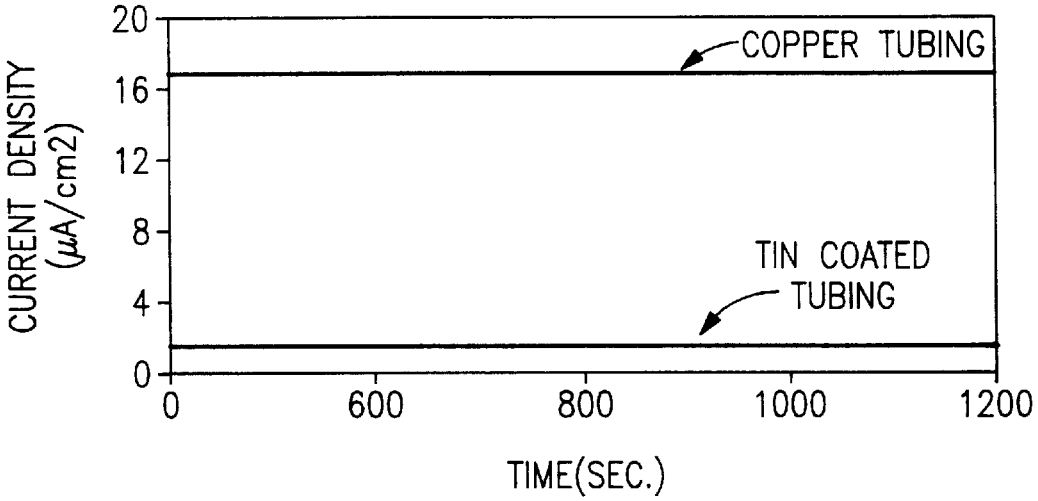
FIG. 2 is a graph illustrating the performance improvements achieved in accordance with the principles of the present invention.

As shown by the galvanic series in FIG. 2, aluminum and tin are significantly apart on the galvanic series. The more active aluminum alloy is therefore expected to corrode more rapidly in contact with tin. However, because tin has slow reaction kinetics for the reduction reaction of the corrosion process, the galvanic corrosion process is significantly decreased—by a factor of ~6 to 10× for the discussed application. This low reduction reaction rate, as indicated, substantially reduces corrosion activities which would otherwise have taken place between the more noble copper tube and the less noble fin collars as indicated by FIG. 3.

The improvement achieved using the principles of the present invention is illustrated in FIG. 3, wherein the current density from galvanic corrosion of a heat exchanger in a corrosive environment is shown as reduced by a factor of ten (10). The measured current density is a direct measure of the corrosion rate of the aluminum fins. So, by coating the non-corroding copper tubing with a metal that is not compatible with aluminum (based upon the galvanic series), the corrosion rate of the aluminum fins is reduced by up to an order of magnitude. While pure tin is the preferred material, tin alloys containing such metals as zinc, magnesium, copper, gallium, cadmium and lead will also reduce the rate of the reduction reaction kinetics and thus the rate of oxidation of the fin material. Other metals also reducing the reduction reaction kinetics may be used alone as well. Inorganic coatings, such as siloxane based systems, that are applied to the copper tubing to reduce the reduction reaction kinetics, and not directly applied to the fins that corrode, may also be used under the principles of the present invention. In addition to applying a distinct coating to the copper surface, this invention also includes enriching the copper surface with the above listed elements to decrease the reduction reaction kinetics on the copper surface. The copper surface can also be coated or impregnated with low levels of elements that inhibit the reduction reaction kinetics, such as arsenic and antimony.

The coating or surface enrichment of the copper tubes 2 with tin or other discussed material is accomplished prior to the assembly of the heat exchanger 10.

This invention includes all coatings that decrease the reduction reaction on the copper surface and thereby lower the galvanic current flowing between the copper and aluminum members of the galvanic couple. The proposed approach is very cost effective and maintains the thermal conduction at the fin/tube interface. High thermal conduction is accomplished by using a coating with a relatively high thermal conductivity or by applying very thin coatings.

There are several methods for applying the protective coating systems to copper tubing. Potential methods include: (1) metal rich paints and sprays, (2) hot dipping, (3) slurry/sintering processes, (4) pack diffusion processes, (5) physical vapor deposition (e.g., evaporation, sputtering, and IVD), (6) chemical vapor deposition, (7) plasma and flame spraying, (8) electroplating, (9) electroless plating and (10) electrophoresis.

An important aspect of the present invention is the production of a uniform coating of reduction reaction reducing material over the entire surface of the flow circuit tubes 2. Regardless of the process contemplated, the variables of tube surface preparation, tube preheat temperature, coating composition, and coating thickness need to be carefully controlled to achieve the proper results of the present invention. The preparation of the exposed surfaces of the tube is preferred to remove the surface oxide layer from the copper to ensure that the coating material will adhere well to the tube. A number of surface preparation processes are known in industry and include the use of reducing gases, fluxes and mechanical abrasion such as shot blasting.

It is preferred that the coating have high ductility to allow for the subsequent assembly of the heat exchanger without damaging the coating. The ductility of the coating is determined in part by the coating composition and the thickness of the coating. The coating must be thick enough to prevent the penetration of the electrolyte, and, thin enough to have good formability and cost benefits. The optimal range of thickness contemplated by the present invention is 0.1 mils to 2 mils.

The primary advantage of this invention is that an article is provided, preferably a heat exchanger, having improved corrosion resistance properties when used in a corrosive environment. Another advantage of this invention is that a plate-fin heat exchanger formed from the preferred materials of copper and aluminum, for the tube and fins, respectively, is provided having reduced reduction reaction kinetics for inhibiting corrosion activities between these materials. Yet another advantage of this invention is that a plate-fin heat exchanger formed from the preferred materials of copper and aluminum, for the tube and fins, respectively, is provided having a reduction reaction kinetics reducing surface treatment on the non-galvanically corroding copper tube for inhibiting corrosion of the less noble aluminum fin collars relative the more noble copper tube. Still another advantage of this invention is that a plate-fin heat exchanger formed from the preferred materials of copper and aluminum, for the tube and fins, respectively, is provided having a surface treatment of tin on the non-galvanically corroding copper tube. This substantially reduces the reduction reaction kinetics otherwise a property of the copper, for inhibiting galvanic corrosion of the less noble aluminum fin collars relative to the more noble copper tube.

Although the invention has been shown and described with respect to the best mode embodiment thereof, it should be understood by those skilled in the art that the foregoing and various other changes, omissions, and additions in the form and detail thereof may be made without departing from the spirit and scope of the invention.

What is claimed is:

1. A heat exchanger comprising:

a fin collar formed from aluminum:

a tube connected with said fin collar at a contact area, said tube formed from copper having a surface and having high reduction reaction kinetics relative said aluminum, wherein said copper is more noble than said aluminum; and a tin coating on said copper of said tube having means for reducing the reduction reaction kinetics of said copper for reducing corrosion activities of the aluminum of said fin collar relative to the copper of the tubes in the presence of an electrolyte.

2. A method for forming an article exhibiting improved galvanic corrosion resistance, comprising the steps of:

forming a heat exchanger fin collar from aluminum;

forming a heat exchanger tube from a copper which is more noble than aluminum, wherein said beat exchanger tube has a surface;

connecting said heat exchanger tube and said heat exchanger fin collar at a contact area; and treating said contact surface of said heat exchanger tube at least at said contact area with a layer of tin for reducing the reduction reaction kinetics of said second metal at least on said surface, prior to said step of connecting, and preventing direct contact between said surface of said heat exchanger tuba and said heat exchanger fin collar to substantially prevent corrosion of said aluminum of said heat exchanger fin collar relative to said copper of said heat exchanger tube.

3. The method according to claim 2, wherein said step of treating comprises enriching said surface with said means for reducing reduction reaction kinetics prior to said step of connecting.

4. The method of claim 3, wherein substantially all of said surface is enriched with said means for reducing reduction reaction kinetics in said step of enriching.

5. A heat exchanger comprising:

a fin collar formed from aluminum:

a tube connected with said fin collar at a contact area, said tube formed from copper having a surface and having high reduction reaction kinetics relative said aluminum, wherein said copper is more noble than said aluminum; and a tin layer impregnated in said surface of said copper of said tube having means for reducing the reduction reaction kinetics of said copper for reducing corrosion activities of the aluminum of said fin collar relative to the copper of the tubes in the presence of an electrolyte.

* * * * *